US010643546B2

(12) United States Patent
Lee et al.

(10) Patent No.: US 10,643,546 B2
(45) Date of Patent: May 5, 2020

(54) GATE DRIVER AND DISPLAY DEVICE INCLUDING THE SAME

(71) Applicant: LG Display Co., Ltd., Seoul (KR)

(72) Inventors: Minho Lee, Paju-si (KR); Seunghee Kuk, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/034,274

(22) Filed: Jul. 12, 2018

(65) Prior Publication Data

US 2019/0172397 A1 Jun. 6, 2019

(30) Foreign Application Priority Data

Dec. 1, 2017 (KR) ..... 10-2017-0164392

(51) Int. Cl.
*G09G 3/3266* (2016.01)
*G09G 3/32* (2016.01)
*G09G 3/3233* (2016.01)

(52) U.S. Cl.
CPC ..... *G09G 3/3266* (2013.01); *G09G 3/3233* (2013.01); *G09G 2300/0819* (2013.01); *G09G 2310/0286* (2013.01)

(58) Field of Classification Search
CPC ..... G09G 3/3266; G09G 2310/0286; G09G 3/3233
See application file for complete search history.

(56) References Cited

U.S. PATENT DOCUMENTS 10,403,195 B2 * 9/2019 Zhu ..... G11C 19/18
2009/0262051 A1 * 10/2009 Kim ..... G09G 3/3266 345/80
2015/0138180 A1 * 5/2015 Park ..... G09G 3/3233 345/212
2017/0116926 A1 * 4/2017 Bong ..... G09G 3/3266

* cited by examiner

*Primary Examiner* — Xuemei Zheng
(74) *Attorney, Agent, or Firm* — Fenwick & West LLP

(57) ABSTRACT

A gate driver and a display device including the same are disclosed. The gate driver includes a plurality of stages. Each stage includes a transistor T6 outputting an emission signal of a gate-on voltage to a node Na while a node Q is activated, a transistor T7 outputting the emission signal of a gate-off voltage to the node Na while a node QB is activated, a Q controller controlling a voltage of the node Q depending on a clock signal ECLK1 and a clock signal ECLK2 that are in antiphase, and a voltage of a node Q', a QB controller controlling a voltage of the node QB depending on the clock signal ECLK1, the voltage of the node Q, and the voltage of the node Q', and a capacitor CQ connected between an input terminal of the clock signal ECLK1 and the node Q.

12 Claims, 15 Drawing Sheets

GATE DRIVER AND DISPLAY DEVICE INCLUDING THE SAME

CROSS-REFERENCE TO RELATED APPLICATIONS

This application claims the priority to Republic of Korea Patent Application No. 10-2017-0164392 filed on Dec. 1, 2017 with the Korean Intellectual Property office, which is incorporated herein by reference in its entirety.

BACKGROUND

Field of Technology

The present disclosure relates to a gate driver and a display device including the same.

Discussion of the Related Art

An electroluminescent display is classified into an inorganic electroluminescent display and an organic electroluminescent display depending on a material of an emission layer. An active matrix organic light emitting diode (OLED) display includes a plurality of OLEDs capable of emitting light by themselves and has many advantages of fast response time, high emission efficiency, high luminance, wide viewing angle, and the like.

An OLED display includes pixels arranged in a matrix and adjusts a luminance of the pixels in accordance with gray levels of image data. Each pixel includes an OLED, a driving thin film transistor (TFT) controlling a driving current flowing in the OLED depending on a gate-to-source voltage of the driving TFT, and switching TFTs programming the gate-to-source voltage of the driving TFT in response to a scan signal. The pixel adjusts a display gray level (or a luminance) with an amount of light emitted by the OLED proportional to the driving current. Each pixel may further include an emission TFT that is turned on or off in response to an emission signal and determines emission timing of the OLED.

The OLED display includes a scan driver generating the scan signal and an emission driver generating the emission signal. The scan driver and the emission driver constitute a gate driver.

The scan driver sequentially supplies the scan signals to first gate lines. Gate electrodes of the switching TFTs are connected to the scan driver through the first gate lines. The emission driver sequentially supplies the emission signals to second gate lines. Gate electrodes of the emission TFTs are connected to the emission driver through the second gate lines.

The emission driver may be implemented as a gate shift register including a plurality of stages. Each stage outputs the emission signal at a gate-on voltage or a gate-off voltage depending on a voltage of a node Q and a voltage of a node QB. The emission signal of the gate-on voltage is a signal capable of turning off the emission TFTs, and the emission signal of the gate-off voltage is a signal capable of turning on the emission TFTs. The emission signal of the gate-on voltage is output while the node Q is activated, and the emission signal of the gate-off voltage is output while the node QB is activated.

SUMMARY

An initialization operation and an emission operation of pixels are performed while an emission signal of a gate-on voltage is output. The initialization operation is performed to initialize a specific node of the pixel, and the emission operation is performed to make an organic light emitting diode (OLED) emit light with a driving current of the OLED. An output voltage level of the emission signal has to be stabilized so as to secure operation stability of the pixels. Namely, the emission signal has to be output at the gate-on voltage in an initialization period and an emission period.

However, an output voltage of the emission signal is affected by a parasitic capacitance connected to a node Q, change in characteristics of an output buffer connected to an output node, and the like. Thus, when the parasitic capacitance connected to the node Q increases or off-current characteristics of the output buffer are reduced, the output voltage of the emission signal is not held at the gate-on voltage and may be changed to another voltage. When the output voltage of the emission signal is not held at the gate-on voltage, an amount of driving current applied to the OLED is changed. As a result, display quality of a display device may be reduced.

Accordingly, an object of the present disclosure is to address the above-described and other problems and provide a gate driver capable of improving display quality by stabilizing an output voltage of an emission signal and a display device including the gate driver.

In one aspect, there is provided a gate driver comprising a plurality of stages, wherein each stage includes a transistor T6 configured to output an emission signal of a gate-on voltage to a node Na while a node Q is activated, a transistor T7 configured to output the emission signal of a gate-off voltage to the node Na while a node QB is activated, a Q controller configured to control a voltage of the node Q depending on a clock signal ECLK1 and a clock signal ECLK2 that are in antiphase, and a voltage of a node Q', a QB controller configured to control a voltage of the node QB depending on the clock signal ECLK1, the voltage of the node Q, and the voltage of the node Q', and a capacitor CQ connected between an input terminal of the clock signal ECLK1 and the node Q and having a first capacitance, wherein a ratio of the first capacitance to a total capacitance including the first capacitance and a parasitic capacitance formed in the node Q is 50% or more.

BRIEF DESCRIPTION OF THE DRAWINGS

The accompanying drawings, that may be included to provide a further understanding of the disclosure and are incorporated in and constitute a part of this specification, illustrate embodiments of the disclosure and together with the description serve to explain various principles of the disclosure.

DETAILED DESCRIPTION

Figure 1:
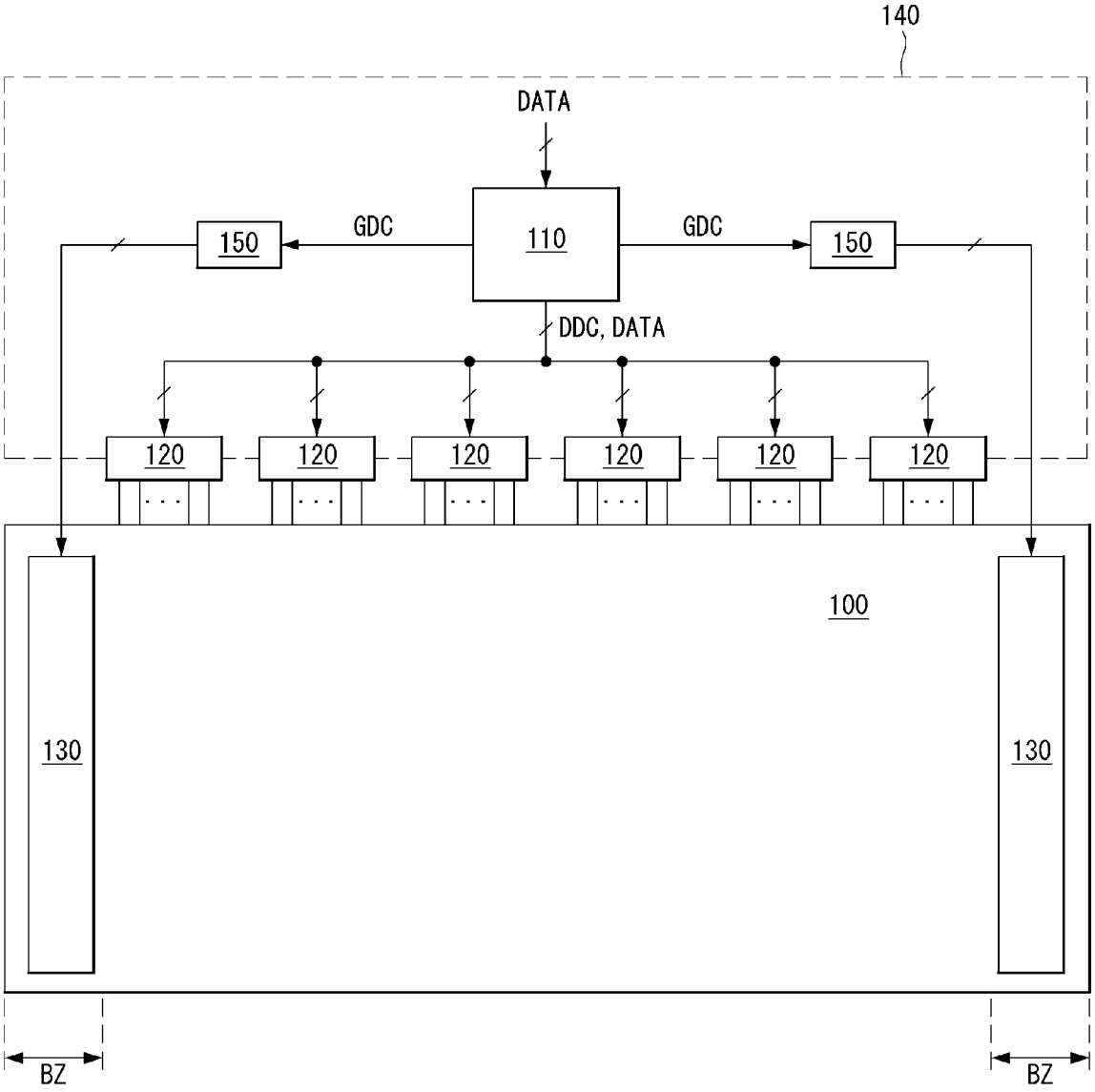
FIG. 1 illustrates a display device according to an embodiment of the disclosure.

Reference will now be made in detail to embodiments of the disclosure, examples of which are illustrated in the accompanying drawings. However, the present disclosure is not limited to embodiments disclosed below, and may be implemented in various forms. These embodiments are provided so that the present disclosure will be described more completely, and will fully convey the scope of the present disclosure to those skilled in the art to which the present disclosure pertains. Particular features of the present disclosure can be defined by the scope of the claims.

Shapes, sizes, ratios, angles, number, and the like illustrated in the drawings for describing embodiments of the disclosure are merely exemplary, and the present disclosure is not limited thereto unless specified as such. Like reference numerals designate like elements throughout. In the following description, when a detailed description of certain functions or configurations related to this document that may unnecessarily cloud the gist of the present disclosure have been omitted.

In the present disclosure, when the terms "include", "have", "comprised of", etc. are used, other components may be added unless "~ only" is used. A singular expression can include a plural expression as long as it does not have an apparently different meaning in context.

In the explanation of components, even if there is no separate description, it is interpreted as including margins of error or an error range.

In the description of positional relationships, when a structure is described as being positioned "on or above", "under or below", "next to" another structure, this description should be construed as including a case in which the structures directly contact each other as well as a case in which a third structure is disposed therebetween.

The terms "first", "second", etc. may be used to describe various components, but the components are not limited by such terms. The terms are used only for the purpose of distinguishing one component from other components. For example, a first component may be designated as a second component, and vice versa, without departing from the scope of the present disclosure.

In embodiments disclosed herein, each of a pixel circuit and a gate driver on a substrate of a display panel may be implemented as transistors of p-type metal oxide semiconductor field effect transistor (MOSFET) structure. However, embodiments are not limited thereto. The transistor is a three-electrode element including a gate, a source, and a drain. The source is an electrode for supplying carriers to the transistor. The carriers inside the transistor begin to flow from the source. The drain is an electrode from which the carriers exit the transistor. Namely, carriers in the MOSFET flow from the source to the drain. In case of a p-type thin film transistor (TFT) (or p-type MOSFET (PMOS)), because carriers are holes, a source voltage is greater than a drain voltage so that holes can flow from a source to a drain. In the p-type TFT, because holes flow from the source to the drain, a current flows from the source to the drain. It should be noted that the source and the drain of the MOSFET are not fixed. For example, the source and the drain of the MOSFET may be changed depending on an applied voltage. Thus, in embodiments disclosed herein, one of the source and the drain is referred to as a first electrode, and the other is referred to as a second electrode.

The following embodiments are described using an organic light emitting diode (OLED) display including an organic light emitting material as an example of a display device. However, it should be noted that the technical idea of the present disclosure is not limited to the OLED display. For example, the present disclosure may be applied to an inorganic electroluminescent display including an inorganic electroluminescent material.

Figure 2:
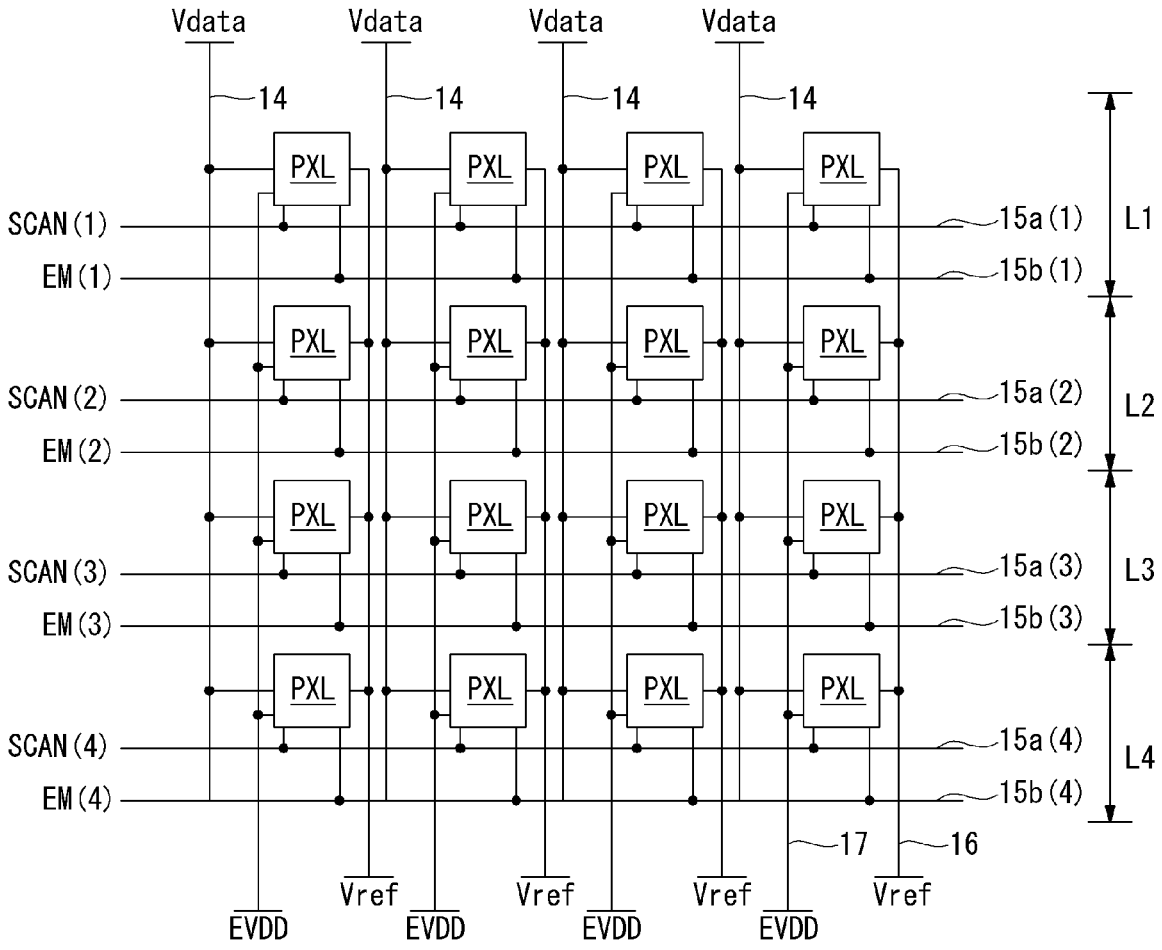
FIG. 2 illustrates a pixel array included in a display panel shown in FIG. 1.
Figure 3:
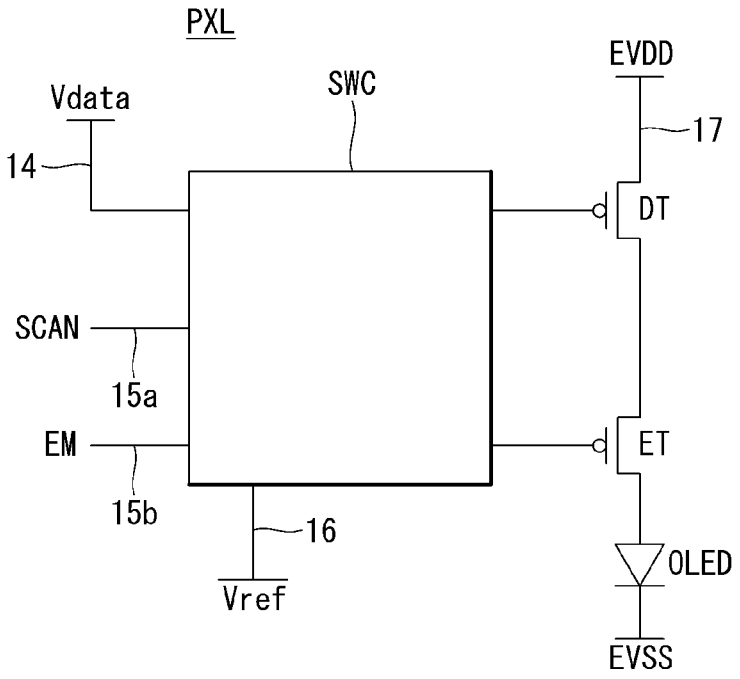
FIG. 3 schematically illustrates a pixel circuit included in a pixel array shown in FIG. 2.
Figure 4:
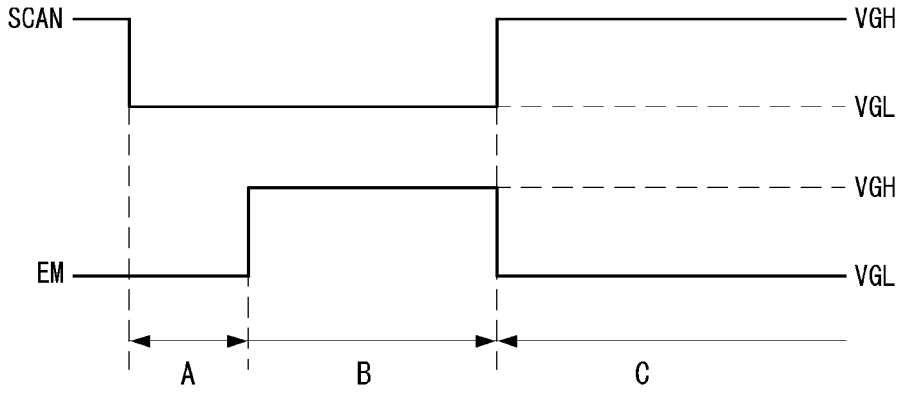
FIG. 4 illustrates a gate signal applied to a pixel circuit shown in FIG. 3.
Figure 5:
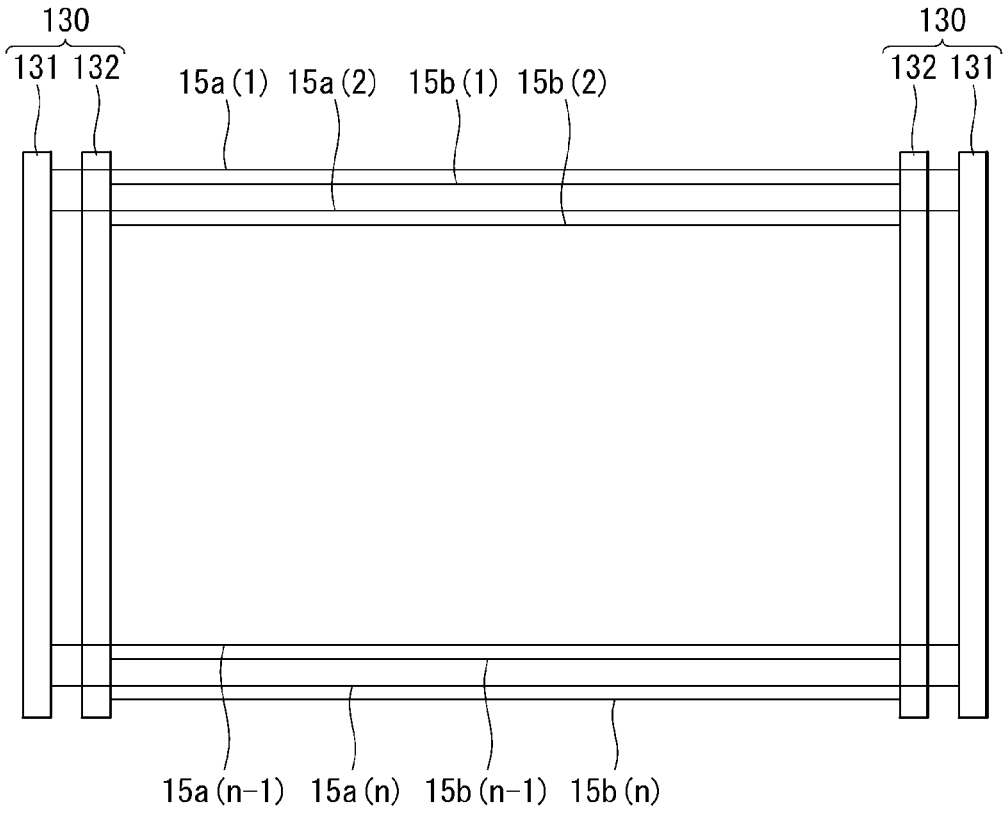
FIG. 5 illustrates a scan driver and an emission driver included in a gate driver shown in FIG. 1.

FIG. 1 illustrates a display device according to an embodiment of the disclosure. FIG. 2 illustrates a pixel array included in a display panel shown in FIG. 1. FIG. 3 schematically illustrates a pixel circuit included in a pixel array shown in FIG. 2. FIG. 4 illustrates a gate signal applied to a pixel circuit shown in FIG. 3. FIG. 5 illustrates a scan driver and an emission driver included in a gate driver shown in FIG. 1.

Referring to FIGS. 1 and 2, a display device according to an embodiment of the disclosure includes a display panel 100, a timing controller 110, a data driver 120, a gate driver 130, and a level shifter 150, and the like.

A plurality of data lines 14 and a plurality of gate lines 15*a* and 15*b* are disposed to intersect each other on the display panel 100. Pixels PXL are respectively arranged at intersections of the data lines 14 and the gate lines 15*a* and 15*b* in a matrix to form a pixel array.

As shown in FIG. 2, the pixel array of the display panel 100 includes a plurality of horizontal pixel lines L1 to L4. The pixels PXL, which are horizontally adjacent to one another and are commonly connected to the gate lines 15*a* and 15*b*, are disposed on each of the horizontal pixel lines L1 to L4. In embodiments disclosed herein, each of the horizontal pixel lines L1 to L4 is not a physical signal line but a set of pixels implemented by horizontally adjacent pixels PXL of one line. The pixel array may include first power lines 17 supplying a high potential power voltage EVDD to the pixels PXL and second power lines 16 supplying a reference voltage Vref to the pixels PXL. Further, the pixels PXL may be connected to an input terminal of a low potential power voltage EVSS. Each gate line may include a first gate line 15*a* supplied with a scan signal SCAN and a second gate line 15*b* supplied with an emission signal EM.

Each pixel PXL may be one of a red pixel, a green pixel, a blue pixel, and a white pixel for implementation of various colors. A red pixel, a green pixel, a blue pixel, and a white pixel may constitute a unit pixel. The white pixel may be omitted in the unit pixel. A color implemented by the unit pixel may be determined depending on an emission rate of the red pixel, the green pixel, the blue pixel, and the white pixel. Each pixel PXL may be connected to the data line 14, the first gate line 15*a*, the second gate line 15*b*, the first power line 17, the second power line 16, and the like.

As shown in FIG. 3, each pixel PXL may include an organic light emitting diode (OLED), a driving thin film transistor (TFT) DT controlling a driving current flowing in the OLED depending on a gate-to-source voltage of the driving TFT DT, a switch circuit SWC for programming the gate-to-source voltage of the driving TFT DT, and an emission TFT ET that is turned on or off in response to the emission signal EM and determines emission timing of the OLED. The switch circuit SWC may include a plurality of switching TFTs, one or more capacitors, and the like.

Configuration of the switch circuit SWC can be variously modified according to model and specification of the product. The TFTs included in each pixel PXL may be implemented as PMOS low-temperature polycrystalline silicon (LTPS) TFTs, and thus each pixel PXL can secure desired response characteristics through the PMOS LTPS TFTs. However, embodiments are not limited thereto. For example, at least one of the TFTs may be implemented as an NMOS oxide TFT having good off-current characteristics, and other TFTs may be implemented as PMOS LTPS TFTs having good response characteristics.

Each pixel PXL may be driven in response to a gate signal shown in FIG. 4. However, embodiments are not limited thereto. For example, a scan signal may be added prior to the gate signal of FIG. 4.

Each pixel PXL may perform an initialization operation, a programming operation, and an emission operation in response to a scan signal SCAN and an emission signal EM shown in FIG. 4. In an initialization period A, the switch circuit SWC initializes specific nodes of a pixel circuit to the reference voltage Vref and can secure stability and stability of the initialization operation. In a programming period B, the switch circuit SWC programs the gate-to-source voltage of the driving TFT DT based on a data voltage Vdata, and a threshold voltage of the driving TFT DT can be sampled and compensated. In an emission period C, a driving current corresponding to the gate-to-source voltage flows between a source and a drain of the driving TFT DT, and the OLED emits light with the driving current.

The emission TFT ET may be turned on in the initialization period A and the emission period C and may be turned off in the programming period B in response to the emission signal EM. To this end, the emission signal EM has to be held at a gate-on voltage during the initialization period A and the emission period C and has to be held at a gate-off voltage during the programming period B. When an output voltage of the emission signal EM is not held at the gate-on voltage, an amount of driving current applied to the OLED may be changed. Thus, the present disclosure proposes various methods capable of stabilizing the output voltage of the emission signal EM. The methods will be described later with reference to FIGS. 6 to 11F.

The gate-on voltage is a voltage of the gate signal capable of turning on the TFT, and the gate-off voltage is a voltage of the gate signal capable of turning off the TFT. For example, a gate-on voltage in the PMOS is gate low voltages VGL and VEL of FIG. 4, and a gate-off voltage in the PMOS is gate high voltages VGH and VEH of FIG. 4 higher than the gate low voltages VGL and VEL. In FIG. 4, the gate-on voltages VGL and VEL may be equal to or different from each other, and the gate-off voltages VGH and VEH may be equal to or different from each other.

Referring to FIG. 1, the data driver 120 receives image data DATA from the timing controller 110. The data driver 120 converts the image data DATA into gamma compensation voltages in response to a source timing control signal DDC received from the timing controller 110 and generates data voltages Vdata. The data driver 120 synchronizes the data voltage Vdata with the scan signal SCAN and supplies the data voltage Vdata to the data lines 14 of the display panel 100. The data driver 120 may be connected to the data lines 14 of the display panel 100 through a chip-on glass (COG) process or a tape automated bonding (TAB) process.

Referring to FIG. 1, the level shifter 150 boosts a transistor-transistor logic (TTL) level voltage of a gate timing control signal GDC received from the timing controller 110 to the gate-on voltages VGL and VEL and the gate-off voltages VGH and VEH capable of driving the TFTs of the display panel 100 and supplies them to the gate driver 130. The gate timing control signal GDC may include an external start signal, a clock signal, and the like.

Referring to FIG. 1, the gate driver 130 operates in response to the gate timing control signal GDC received from the level shifter 150 and generates the gate signals. The gate driver 130 sequentially supplies the gate signals to the gate lines. The gate driver 130 may be directly formed on a lower substrate of the display panel 100 using a gate driver-in panel (GIP) manner. The gate driver 130 may be formed in a non-display area (i.e., a bezel area BZ) outside a screen of the display panel 100. In the GIP manner, the level shifter 150 may be mounted on a printed circuit board (PCB) 140 together with the timing controller 110.

As shown in FIG. 5, the gate drivers 130 are disposed on opposite sides of the display panel 100 in a double bank structure and can reduce signal distortion resulting from a load variation. The gate driver 130 includes a scan driver 131 generating the scan signal SCAN and an emission driver 132 generating the emission signal EM.

The scan driver 131 may supply the scan signals SCAN to first gate lines 15*a*(1) to 15*a*(*n*) in a line sequential manner. The emission driver 132 may supply the emission signals EM to second gate lines 15*b*(1) to 15*b*(*n*) in a line sequential manner. The emission driver 132 may be implemented as a gate shift register including a plurality of stages. Each stage of the emission driver 132 may be implemented as shown in FIGS. 6 to 11F in order to stabilize an output level of the emission signal EM.

Referring to FIG. 1, the timing controller 110 may be connected to an external host system (not shown) through known various interface manners. The timing controller 110 receives the image data DATA from the host system. The timing controller 110 may correct the image data DATA and then transmit the corrected image data DATA to the data driver 120, so that a luminance variation resulting from a difference between electrical characteristics of the pixels PXL is compensated.

The timing controller 110 receives timing signals such as a vertical sync signal Vsync, a horizontal sync signal Hsync, a data enable signal DE, and a main clock MCLK from the host system. The timing controller 110 may generate the gate timing control signal GDC and the source timing control signal DDC based on the timing signals.

Figure 6:
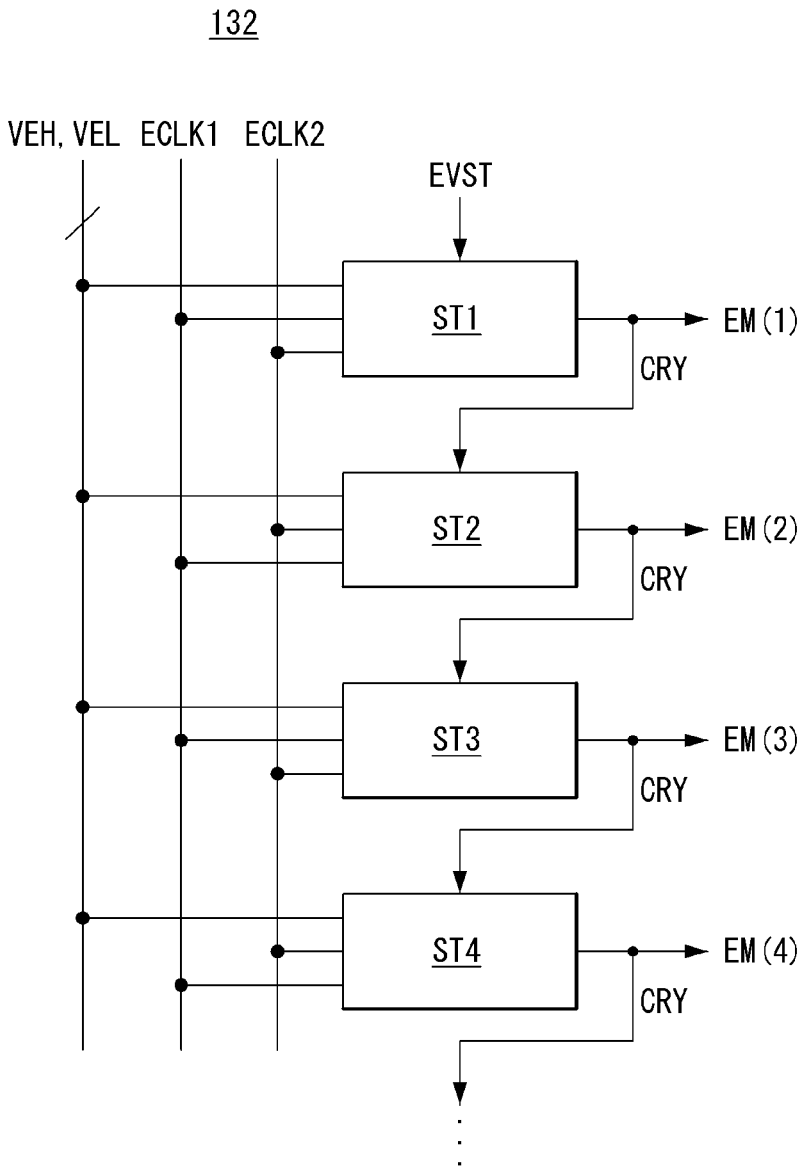
FIG. 6 illustrates configuration of a gate shift register included in an emission driver shown in FIG. 5.

FIG. 6 illustrates configuration of a gate shift register included in the emission driver shown in FIG. 5.

Referring to FIG. 6, the emission driver 132 according to the embodiment of the disclosure may be implemented as a gate shift register including a plurality of stages ST1 to ST4. The stages ST1 to ST4 may be GIP elements formed in the GIP manner.

Operations of the stages ST1 to ST4 are sequentially activated in response to a start signal and output emission signals EM(1) to EM(4). An operation of the uppermost stage ST1 is activated in response to an external start signal EVST, and operations of the second uppermost stage ST2 below the uppermost stage ST1 to a lowermost stage are activated in response to an emission signal of a previous stage. The emission signal of the previous stage is used as an internal start signal and is a carry signal CRY. In embodiments disclosed herein, "previous stage" is a stage that is activated earlier than a reference stage and generates an emission signal of which a phase is earlier than a phase of an emission signal output from the reference stage.

The stages ST1 to ST4, . . . receive the external start signal EVST, a first clock signal ECLK1, and a second clock signal ECLK2 from the level shifter 150 in order to output the emission signals EM(1) to EM(4). The external start signal EVST, the first clock signal ECLK1, and the second clock signal ECLK2 may swing between the gate-off voltage VEH and the gate-on voltage VEL.

The external start signal EVST is input to the uppermost stage ST1, and the first clock signal ECLK1 and the second clock signal ECLK2 are input to all the stages ST1 to ST4. The first clock signal ECLK1 and the second clock signal ECLK2 are in antiphase. Thus, input positions of the first clock signal ECLK1 and the second clock signal ECLK2 in odd-numbered stages may be set to be opposite to those in even-numbered stages, in order to normally operate each of the stages that are connected in cascade. For example, when the first clock signal ECLK1 is input to first clock terminals of the odd-numbered stages and the second clock signal ECLK2 is input to second clock terminals of the odd-numbered stages, the first clock signal ECLK1 may be input to second clock terminals of the even-numbered stages and the second clock signal ECLK2 may be input to first clock terminals of the even-numbered stages.

Each of the stages ST1 to ST4 activates an operation of a node Q in response to the start signal applied to a start terminal in each frame. In embodiments disclosed herein, the fact that a node is activated indicates that the gate-on voltage VEL or a voltage lower than the gate-on voltage VEL is applied to the node. Further, the fact that a node is deactivated indicates that the gate-off voltage VEH or a voltage higher than the gate-off voltage VEH is applied to the node. In addition, the fact that a voltage of the node Q is bootstrapped indicates that the voltage of the node Q is reduced to a voltage lower than the gate-on voltage VEL. Thus, the node Q can maintain an activation state even while the voltage of the node Q is bootstrapped.

Each of the stages ST1 to ST4 receives the gate-off voltage VEH and the gate-on voltage VEL from an external power supply unit. For example, the gate-off voltage VEH may be set to 20V to 30V, and the gate-on voltage VEL may be set to −10V to 0V. However, embodiments are not limited thereto.

Figure 7:
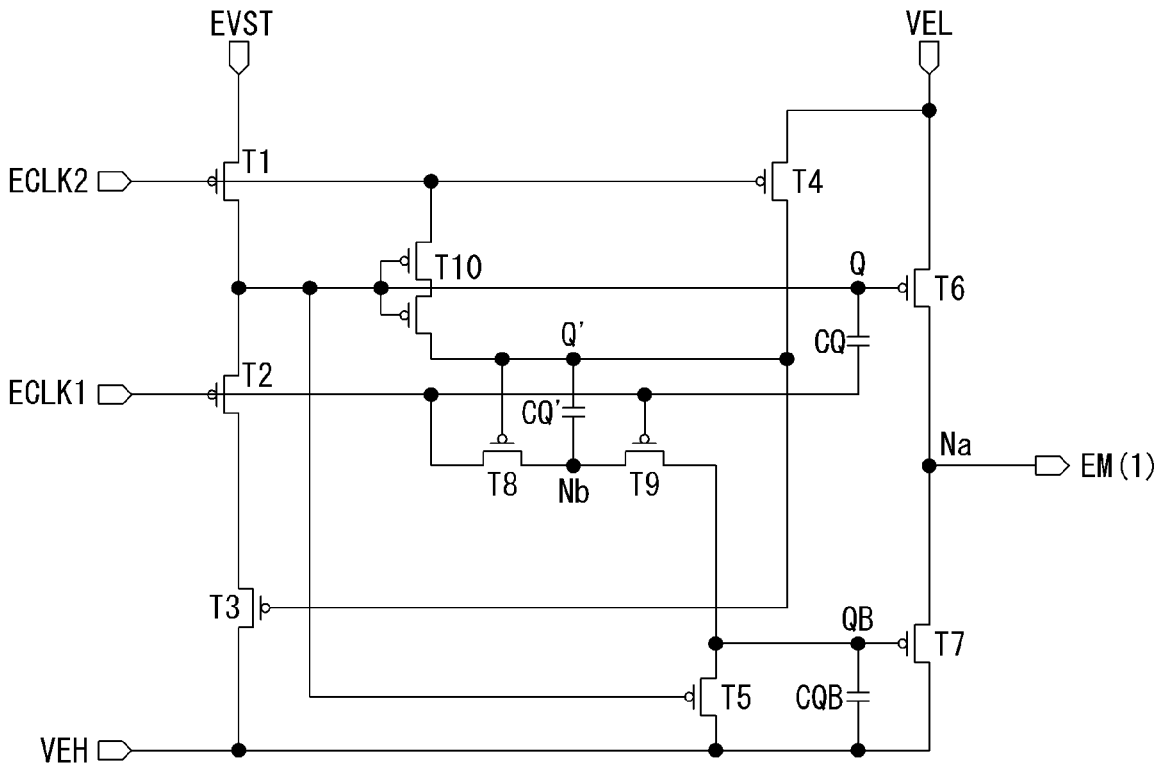
FIG. 7 illustrates configuration of a stage included in a gate shift register shown in FIG. 6.
Figure 8:
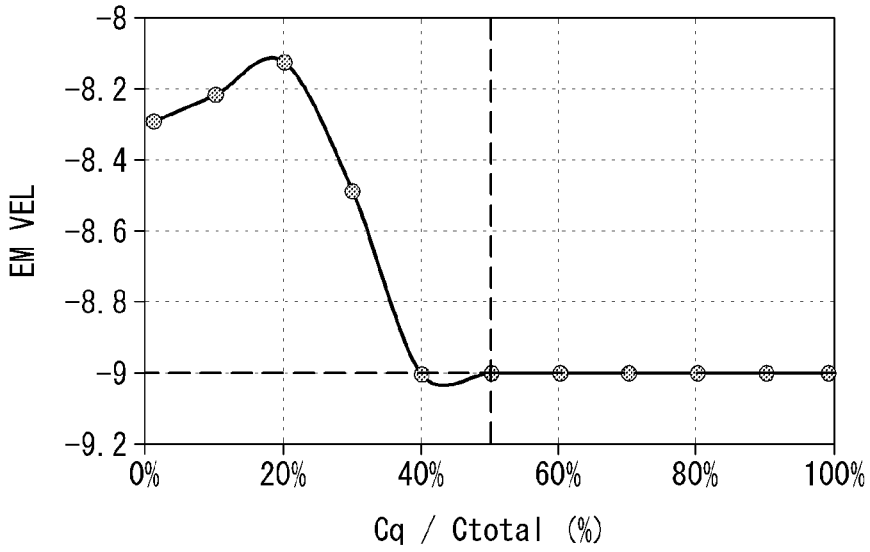
FIG. 8 is a simulation result waveform illustrating change in an output voltage of an emission signal depending on a ratio of a capacitance Cq to a total capacitance.

FIG. 7 illustrates configuration of the uppermost stage ST1 included in the gate shift register shown in FIG. 6. FIG. 8 is a simulation result waveform illustrating change in an output voltage of an emission signal depending on a ratio of a capacitance Cq to a total capacitance.

Configurations of the remaining odd-numbered stages except the uppermost stage ST1 are substantially the same as configuration of the uppermost stage ST1, except that they receive the internal start signal CRY instead of the external start signal EVST and each output an emission signal having a different phase. Further, configurations of the even-numbered stages are substantially the same as configuration of the uppermost stage ST1, except that they receive the internal start signal CRY instead of the external start signal EVST, receives the second clock signal ECLK2 instead of the first clock signal ECLK1, receives the first clock signal ECLK1 instead of the second clock signal ECLK2, and each output an emission signal having a different phase.

Referring to FIG. 7, the stage ST1 outputs an emission signal EM(1) of the gate-off voltage VEH while the node Q is deactivated to the gate-off voltage VEH and a node QB is activated to the gate-on voltage VEL. Further, the stage ST1 outputs the emission signal EM(1) of the gate-on voltage VEL while the node Q is activated to a voltage equal to or less than the gate-on voltage VEL and the node QB is deactivated to the gate-off voltage VEH. The stage ST1 can hold the emission signal EM(1) at the gate-on voltage VEL of a previous time while both the node Q and the node QB are deactivated to the gate-off voltage VEH (see a period ② in FIG. 10).

To this end, the stage ST1 may include a transistor T6, a transistor T7, a capacitor CQ, a Q controller, and a QB controller. The stage ST1 may further include a Q' controller.

The transistor T6 is a first output buffer of which an operation is controlled depending on the voltage of the node Q. The transistor T6 is turned off when the node Q is deactivated to the gate-off voltage VEH, and is turned on when the node Q is activated to a voltage equal to or less than the gate-on voltage VEL. The transistor T6 outputs the emission signal EM(1) of the gate-on voltage VEL to a node Na while the node Q is activated. A gate electrode of the transistor T6 is connected to the node Q, a first electrode of the transistor T6 is connected to the node Na, and a second electrode of the transistor T6 is connected to an input terminal of the gate-on voltage VEL.

The capacitor CQ is connected between an input terminal of a clock signal ECLK1 and the node Q and has a capacitance Cq.

The capacitor CQ reflects change in a voltage of the clock signal ECLK1 to the voltage of the node Q and functions to bootstrap the node Q. When the clock signal ECLK2 of the gate-off voltage VEH is input after the node Q is activated to the gate-on voltage VEL, the node Q is disconnected from an input terminal of the start signal EVST and is floated. In this instance, when the clock signal ECLK1 of the gate-on voltage VEL is input, the voltage of the node Q is bootstrapped to a voltage lower than the gate-on voltage VEL due to a coupling effect of the node Q and the capacitor CQ. In other words, the voltage of the node Q is bootstrapped every time the clock signal ECLK1 of the gate-on voltage VEL is input within a period in which the emission signal EM(1) of the gate-on voltage VEL is output.

The bootstrapping operation is performed to stabilize the output voltage of the emission signal EM(1) to the gate-on voltage VEL by increasing a gate-to-source voltage of the transistor T6. A change ΔVboost in the voltage of the node Q depending on the bootstrapping depends on the capacitance Cq. Namely, the voltage change ΔVboost of the node Q may be defined by a multiplication ((Cq/Ctotal)*ΔVclk) of a ratio Cq/Ctotal of the capacitance Cq to a total capacitance Ctotal of the node Q and a swing width ΔVclk of the voltage of the clock signal ECLK1. In embodiments disclosed herein, the total capacitance Ctotal of the node Q includes the capacitance Cq and a parasitic capacitance formed at the node Q.

As the gate-to-source voltage of the transistor T6 increases while the voltage of the node Q is bootstrapped, the stabilization effect of the output voltage of the emission signal EM(1) is improved. The gate-to-source voltage of the transistor T6 is proportional to the voltage change ΔVboost of the node Q. Further, the voltage change ΔVboost of the node Q is determined depending on the ratio Cq/Ctotal of the capacitance Cq to the total capacitance Ctotal of the node Q. As shown in FIG. 8, when the ratio Cq/Ctotal is set to be less than 50%, the voltage change ΔVboost of the node Q decreases. Because the gate-to-source voltage of the transistor T6 is reduced by a decrease in the voltage change ΔVboost, a level of the gate-on voltage VEL of the emission signal EM(1) output to the node Na may fluctuate. On the other hand, when the ratio Cq/Ctotal is set to be equal to or greater than 50%, the voltage change ΔVboost of the node Q increases. Because the gate-to-source voltage of the transistor T6 increases by an increase in the voltage change ΔVboost, the emission signal EM(1) can be stably output at the gate-on voltage VEL.

The transistor T7 is a second output buffer of which an operation is controlled depending on a voltage of the node QB. The transistor T7 is turned off when the node QB is deactivated to the gate-off voltage VEH, and is turned on when the node QB is activated to the gate-on voltage VEL. The transistor T7 outputs the emission signal EM(1) of the gate-off voltage VEH to the node Na while the node QB is activated. A gate electrode of the transistor T7 is connected to the node QB, a first electrode of the transistor T7 is connected to an input terminal of the gate-off voltage VEH, and a second electrode of the transistor T7 is connected to the node Na.

The Q controller controls the voltage of the node Q depending on the clock signals ECLK1 and ECLK2 which are in antiphase, and a voltage of a node Q'. The Q controller includes a transistor T1 which is switched in response to the clock signal ECLK2 and applies the start signal EVST to the node Q, a transistor T2 which is switched in response to the clock signal ECLK1 and has a first electrode connected to the node Q, and a transistor T3 which is switched in response to the voltage of the node Q' and applies the gate-off voltage VEH to a second electrode of the transistor T2.

A gate electrode of the transistor T1 is connected to an input terminal of the clock signal ECLK2, a first electrode of the transistor T1 is connected to the input terminal of the start signal EVST, and a second electrode of the transistor T1 is connected to the node Q. A gate electrode of the transistor T2 is connected to an input terminal of the clock signal ECLK1, a first electrode of the transistor T2 is connected to the node Q, and the second electrode of the transistor T2 is connected to a first electrode of the transistor T3. A gate electrode of the transistor T3 is connected to the node Q', the first electrode of the transistor T3 is connected to the second electrode of the transistor T2, and a second electrode of the transistor T3 is connected to the input terminal of the gate-off voltage VEH.

The QB controller controls the voltage of the node QB depending on the clock signal ECLK1, the voltage of the node Q, and the voltage of the node Q'. The QB controller includes a transistor T8 which is switched in response to the voltage of the node Q' and applies the clock signal ECLK1 to a node Nb, a transistor T9 which is switched in response to the clock signal ECLK1 and connects the node Nb to the node QB, a transistor T5 which is switched in response to the voltage of the node Q and applies the gate-off voltage VEH to the node QB, and a capacitor CQB connected between the node QB and the input terminal of the gate-off voltage VEH.

A gate electrode of the transistor T8 is connected to the node Q', a first electrode of the transistor T8 is connected to the input terminal of the clock signal ECLK1, and a second electrode of the transistor T8 is connected to the node Nb. A gate electrode of the transistor T9 is connected to the input terminal of the clock signal ECLK1, a first electrode of the transistor T9 is connected to the node Nb, and a second electrode of the transistor T9 is connected to the node QB. A gate electrode of the transistor T5 is connected to the node Q, a first electrode of the transistor T5 is connected to the node QB, and a second electrode of the transistor T5 is connected to the input terminal of the gate-off voltage VEH. The capacitor CQB functions to hold the voltage of the node QB. Because one electrode of the capacitor CQB is connected to the input terminal of the gate-off voltage VEH, the capacitor CQB can hold the voltage of the node QB.

The Q' controller controls the voltage of the node Q' depending on the clock signals ECLK1 and ECLK2 and the voltage of the node Q. The Q' controller includes a transistor T10 which is switched in response to the voltage of the node Q and applies the clock signal ECLK2 to the node Q', a transistor T4 which is switched in response to the clock signal ECLK2 and applies the gate-on voltage VEL to the node Q', and a capacitor CQ' connected between the node Q' and the node Nb.

A gate electrode of the transistor T10 is connected to the node Q, a first electrode of the transistor T10 is connected to the input terminal of the clock signal ECLK2, and a second electrode of the transistor T10 is connected to the node Q'. A gate electrode of the transistor T4 is connected to the input terminal of the clock signal ECLK2, a first electrode of the transistor T4 is connected to the input terminal of the gate-on voltage VEL, and a second electrode of the transistor T4 is connected to the node Q'. The capacitor CQ' reflects change in a voltage of the clock signal ECLK1 to the node Q'.

Figure 9:
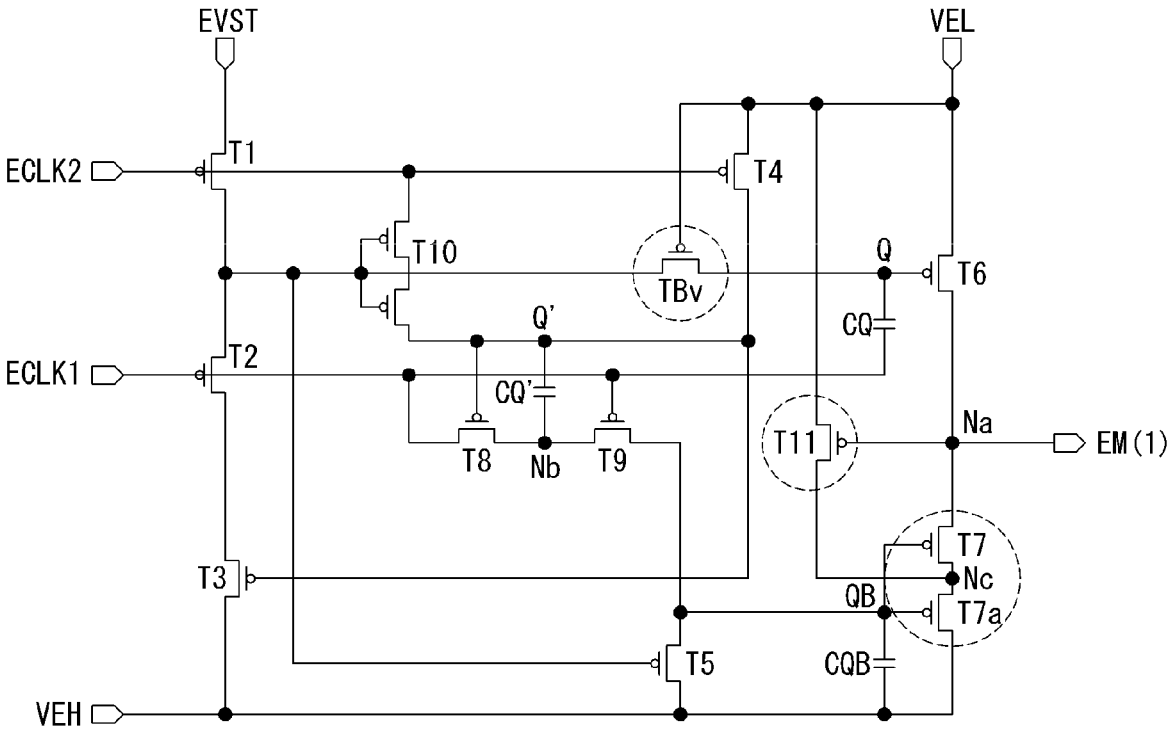
FIG. 9 illustrates a modified example of configuration of a stage shown in FIG. 7.

FIG. 9 illustrates a modified example of configuration of the stage shown in FIG. 7.

A stage shown in FIG. 9 may further include a transistor TBv, a transistor T7*a*, and a transistor T11 compared to the stage shown in FIG. 7.

Referring to FIG. 9, one electrode of the transistor TBv is connected to the node Q, and a gate electrode of the transistor TBv is connected to the input terminal of the gate-on voltage VEL. The transistor TBv is turned off during a period in which the voltage of the node Q is bootstrapped, and maintains a turn-on state in remaining periods except the period. The voltage of the node Q is bootstrapped every time the clock signal ECLK1 of the gate-on voltage VEL is input within a period in which the emission signal EM(1) of the gate-on voltage VEL is output.

Because the transistor TBv is turned off during the period in which the voltage of the node Q is bootstrapped, the transistor TBv can prevent a breakdown phenomenon of the transistors T1, T2 and T10 resulting from change in the voltage of the node Q.

In other words, when one electrode of each of the transistors T1 and T2 is directly connected to the node Q, a source-to-drain voltage of each of the transistors T1 and T2 may increase if the voltage of the node Q is bootstrapped. Hence, a load applied to the transistors T1 and T2 may increase. Further, when the gate electrode of the transistor T10 is directly connected to the node Q, a gate-to-source voltage of the transistor T10 may increase if the voltage of the node Q is bootstrapped. Hence, a load applied to the transistor T10 may increase. The transistor TBv can suppress change in the voltage of the node Q applied to the transistors T1, T2 and T10 and protect the transistors T1, T2 and T10.

Referring to FIG. 9, the transistor T7*a* and the transistor T7 constitute a second output buffer of a dual gate structure. A gate electrode of the transistor T7*a* is connected to the node QB, a first electrode of the transistor T7*a* is connected to the second electrode of the transistor T7 via a node Nc, and a second electrode of the transistor T7*a* is connected to the input terminal of the gate-off voltage VEH. In the dual gate structure, a first gate electrode and a second gate electrode are connected to each other so that they have the same voltage level. A channel length of the dual gate structure is longer than a channel length of a single gate structure. Because an increase in the channel length results in an increase in a resistance, a leakage current decreases when the transistor is turned off. Hence, the operation stability can be secured.

The transistor T11 suppresses a leakage current of the second output buffer implemented by the transistors T7 and T7*a* and stabilizes the emission signal EM(1) of the gate-on voltage VEL output to the node Na. A gate electrode of the transistor T11 is connected to the node Na, a first electrode of the transistor T11 is connected to the input terminal of the gate-on voltage VEL, and a second electrode of the transistor T11 is connected to the node Nc between the transistor T7 and the transistor T7*a*.

The emission signal EM(1) output to the node Na of the stage ST1 of FIG. 9 is held at the gate-on voltage VEL during most of one frame period. If the second output buffer is composed of only the transistor T7, there is a large voltage difference (i.e., a voltage difference between the voltages VEH and VEL) between a drain voltage and a source voltage of the transistor T7 when a voltage of an output node No holds the gate-on voltage VEL. When the large voltage difference lasts for a long time, the transistor T7 is easily deteriorated. When a leakage current flows in the transistor T7 due to the deterioration of the transistor T7, the normal emission signal EM(1) cannot be output.

On the other hand, as shown in FIG. 9, when the transistors T7 and T7*a* constitute the second output buffer and the transistor T11 is connected to the node Nc, the gate-on voltage VEL is applied to the node Nc through the transistor T11 while the voltage of the node Na holds the gate-on voltage VEL. Therefore, a difference (i.e., a difference between the voltages VEL and VEL) between a drain voltage and a source voltage of the transistor T7 is ideally zero. Thus, deterioration of the transistor T7 is prevented. Even if the transistor T7*a* is deteriorated while the voltage of the node Na holds the gate-on voltage VEL, an influence of the leakage current is blocked by the transistor T7. Therefore, the leakage current does not affect the voltage of the node Na.

Figure 10:
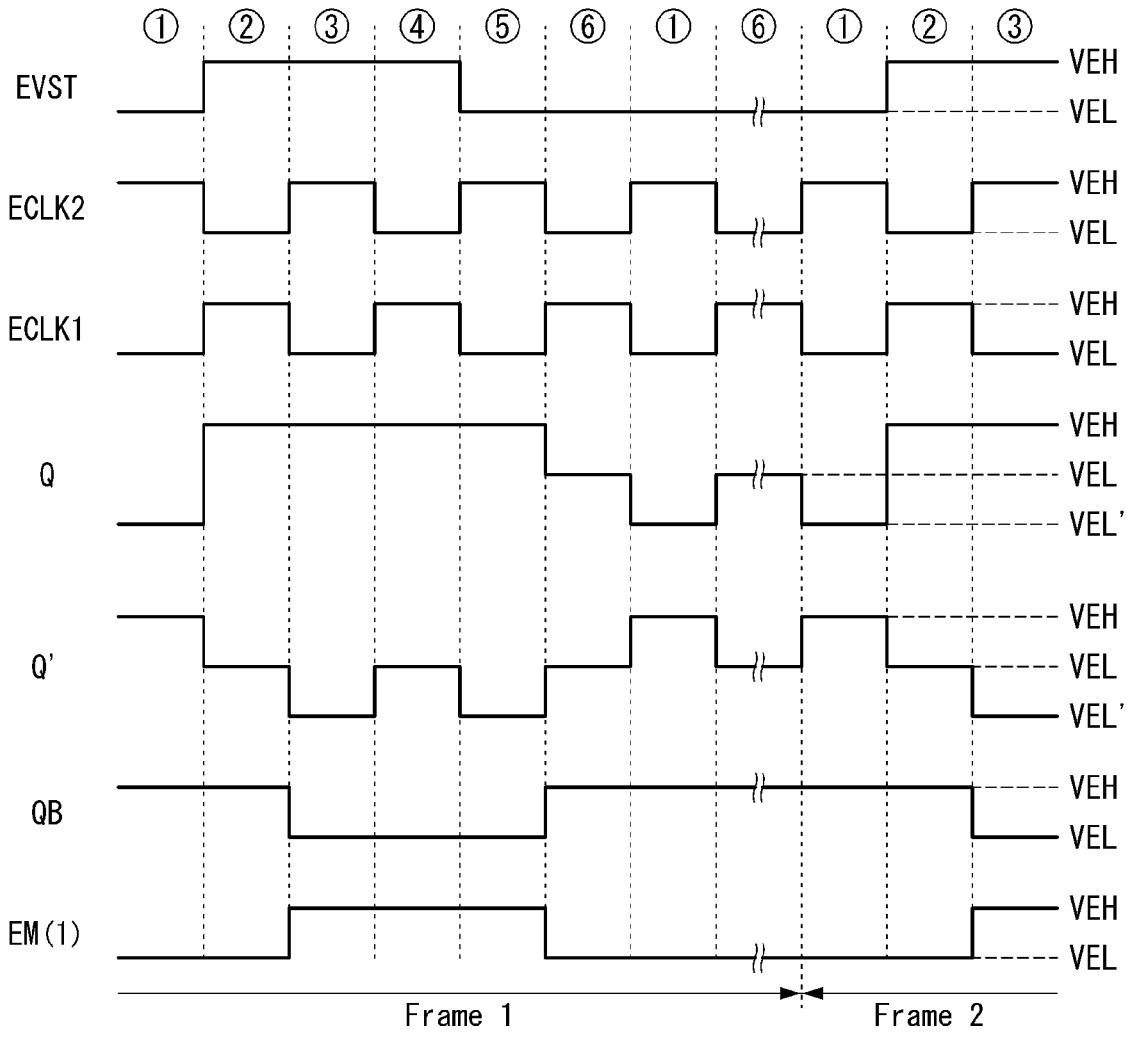
FIG. 10 is a waveform diagram illustrating an operation waveform of a stage shown in FIG. 7.

FIG. 10 is a waveform diagram illustrating an operation waveform of the stage shown in FIG. 7. FIGS. 11A to 11F illustrate operation states of a stage respectively corresponding to periods ① to ⑥ shown in FIG. 10.

Figure 11A:
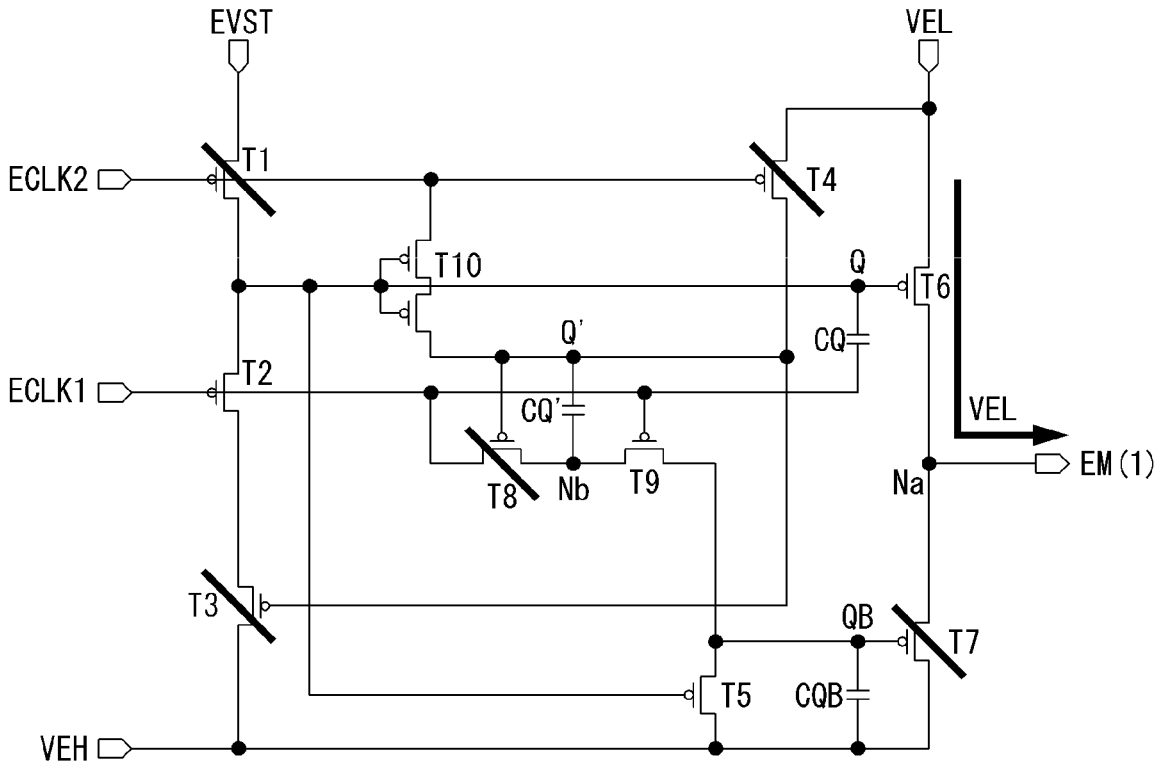
FIGS. 11A to 11F illustrate operation states of a stage respectively corresponding to periods ① to ⑥ shown in FIG. 10.

Referring to FIGS. 10 and 11A, in a period ①, the external start signal EVST and the clock signal ECLK1 are input at the gate-on voltage VEL, and the clock signal ECLK2 is input at the gate-off voltage VEH.

In the period ①, the transistors T2 and T9 are turned on by the clock signal ECLK1 of the gate-on voltage VEL, and the transistors T1 and T4 are turned off by the clock signal ECLK2 of the gate-off voltage VEH. The node Q is floated by the turn-off of the transistor T1. Thus, the voltage of the node Q is bootstrapped by the clock signal ECLK1 of the gate-on voltage VEL and is a boosting voltage VEL' lower than the gate-on voltage VEL.

In the period ①, the transistors T5 and T10 are turned on by the boosting voltage VEL' of the node Q. The voltage of the node QB is the gate-off voltage VEH by the turn-on of the transistor T5, and the voltage of the node Q' is the gate-off voltage VEH by the turn-on of the transistors T5 and T9. Further, the transistor T3 is turned off by the gate-off voltage VEH of the node Q'.

In the period ①, the transistor T6 is turned on by the boosting voltage VEL' of the node Q, and the emission signal EM(1) of the gate-on voltage VEL is output to the node Na. In this instance, the transistor T7 is turned off by the gate-off voltage VEH of the node QB.

Figure 11B:
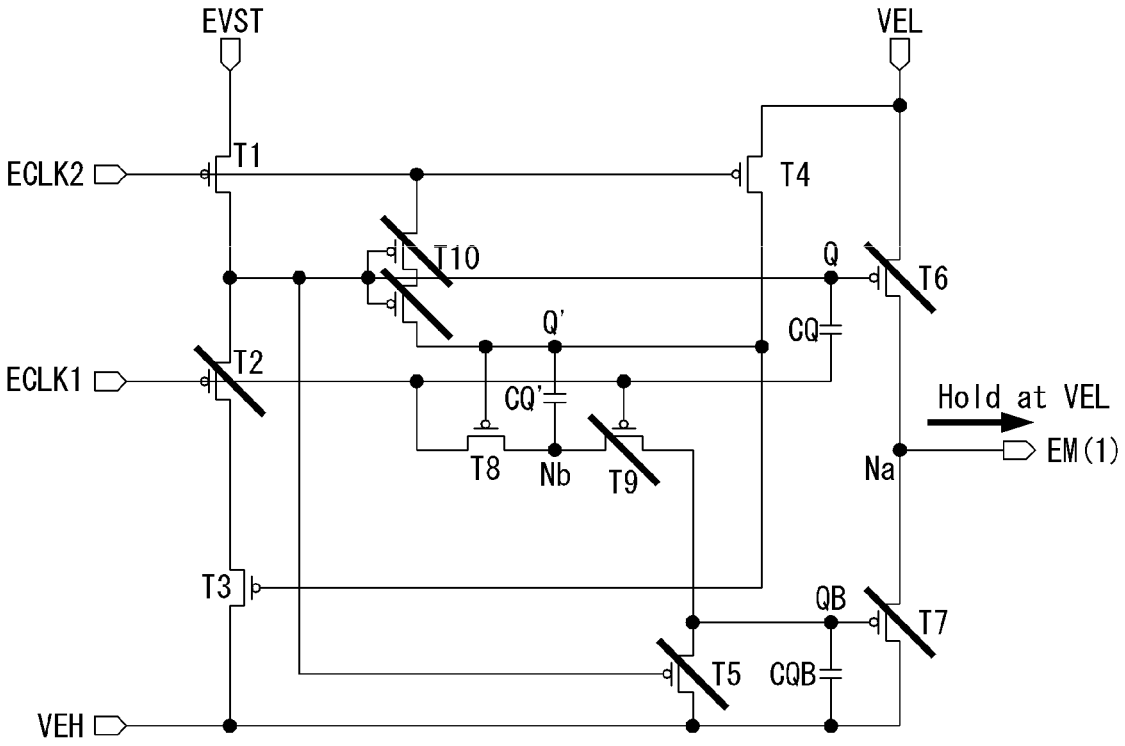

Referring to FIGS. 10 and 11B, in a period ②, the external start signal EVST and the clock signal ECLK1 are input at the gate-off voltage VEH, and the clock signal ECLK2 is input at the gate-on voltage VEL.

In the period ②, the transistors T1 and T4 are turned on by the clock signal ECLK2 of the gate-on voltage VEL. In this instance, the external start signal EVST of the gate-off voltage VEH is applied to the node Q through the transistor T1. Further, the gate-on voltage VEL is applied to the node Q' through the transistor T4.

In the period ②, the transistors T2 and T9 are turned off by the clock signal ECLK1 of the gate-off voltage VEH. The transistors T5 and T10 are turned off by the gate-off voltage VEH of the node Q, and the transistors T3 and T8 are turned on by the gate-on voltage VEL of the node Q'. By the turn-off of the transistors T5 and T9, the node QB is floated and is held at the gate-off voltage VEH that has been held in the period ①.

In the period ②, the transistor T6 is turned off by the gate-off voltage VEH of the node Q, and the transistor T7 maintains an off-state by the gate-off voltage VEH of the node QB. Thus, the node Na is floated, and the emission signal EM(1) of the gate-on voltage VEL is held in the node Na.

Figure 11C:
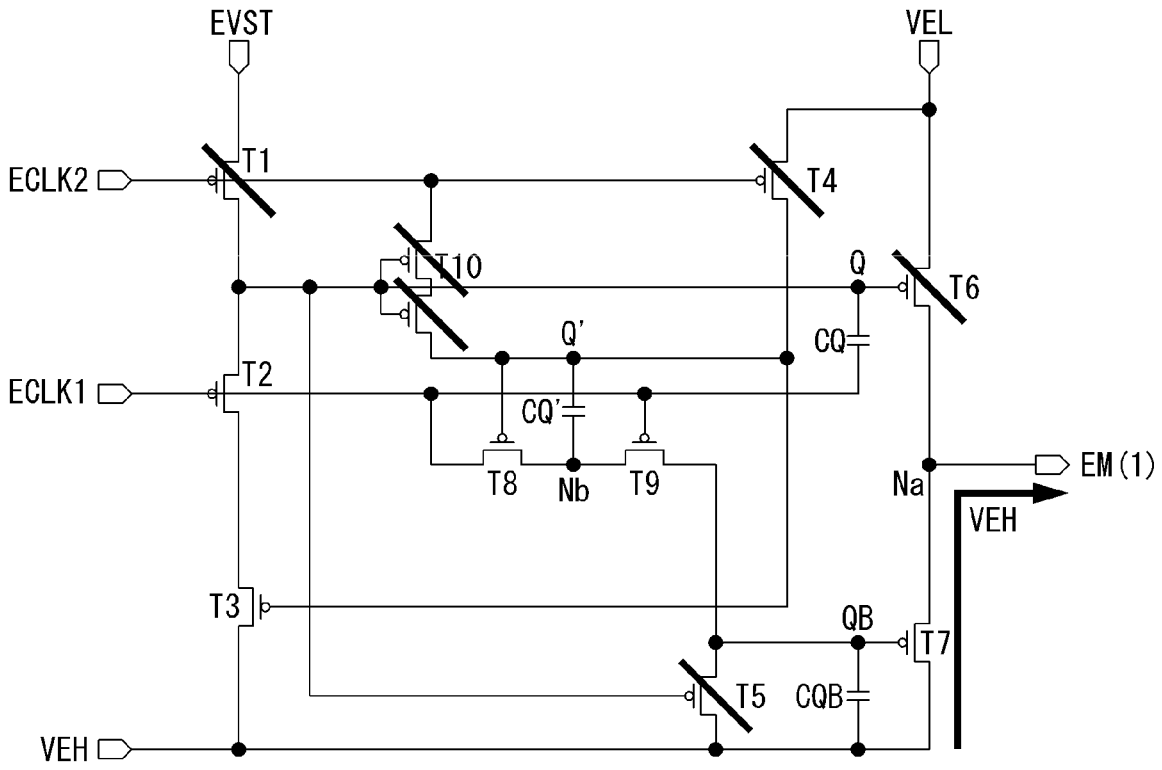

Referring to FIGS. 10 and 11C, in a period ③, the external start signal EVST and the clock signal ECLK2 are input at the gate-off voltage VEH, and the clock signal ECLK1 is input at the gate-on voltage VEL.

In the period ③, the transistors T2 and T9 are turned on by the clock signal ECLK1 of the gate-on voltage VEL, and the transistors T1 and T4 are turned off by the clock signal ECLK2 of the gate-off voltage VEH. By the turn-off of the transistor T4, the node Q' is floated, and the transistor T8 maintains an on-state. In this instance, when the clock signal ECLK1 of the gate-on voltage VEL is applied to the node Nb through the transistor T8, the voltage of the node Q' is the boosting voltage VEL' lower than the gate-on voltage VEL due to a coupling effect of the node Q' and the capacitor CQ'.

In the period ③, the transistor T3 is turned on by the boosting voltage VEL' of the node Q'. Thus, the gate-off voltage VEH is applied to the node Q through the transistors T2 and T3. The transistors T5 and T10 are turned off by the gate-off voltage VEH of the node Q. The clock signal ECLK1 of the gate-on voltage VEL is applied to the node QB through the transistors T8 and T9.

In the period ③, the transistor T6 maintains an off-state by the gate-off voltage VEH of the node Q, and the transistor T7 is turned on by the gate-on voltage VEL of the node QB. The emission signal EM(1) of the gate-off voltage VEH is output to the node Na through the transistor T7.

Figure 11D:
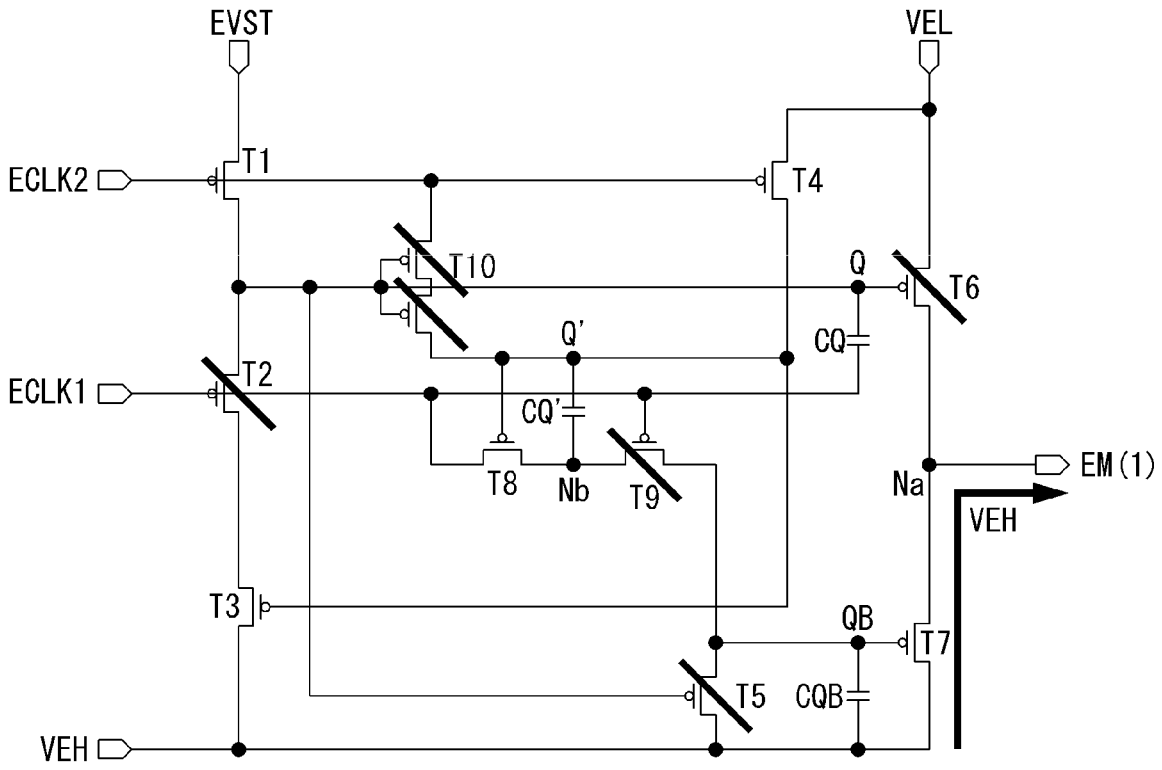

Referring to FIGS. 10 and 11D, in a period ④, the external start signal EVST and the clock signal ECLK1 are input at the gate-off voltage VEH, and the clock signal ECLK2 is input at the gate-on voltage VEL.

In the period ④, the transistors T1 and T4 are turned on by the clock signal ECLK2 of the gate-on voltage VEL. In this instance, the external start signal EVST of the gate-off voltage VEH is applied to the node Q through the transistor T1. The gate-on voltage VEL is applied to the node Q' through the transistor T4.

In the period ④, the transistors T2 and T9 are turned off by the clock signal ECLK1 of the gate-off voltage VEH. The transistors T5 and T10 are turned off by the gate-off voltage VEH of the node Q, and the transistors T3 and T8 are turned on by the gate-on voltage VEL of the node Q'. By the turn-off of the transistors T5 and T9, the node QB is floated, and the voltage of the node QB is held at the gate-on voltage VEL that has been held in the period ③.

In the period ④, the transistor T6 maintains an off-state by the gate-off voltage VEH of the node Q, and the transistor T7 maintains an on-state by the gate-on voltage VEL of the node QB. Thus, the emission signal EM(1) of the gate-off voltage VEH is continuously output to the node Na through the transistor T7.

Figure 11E:
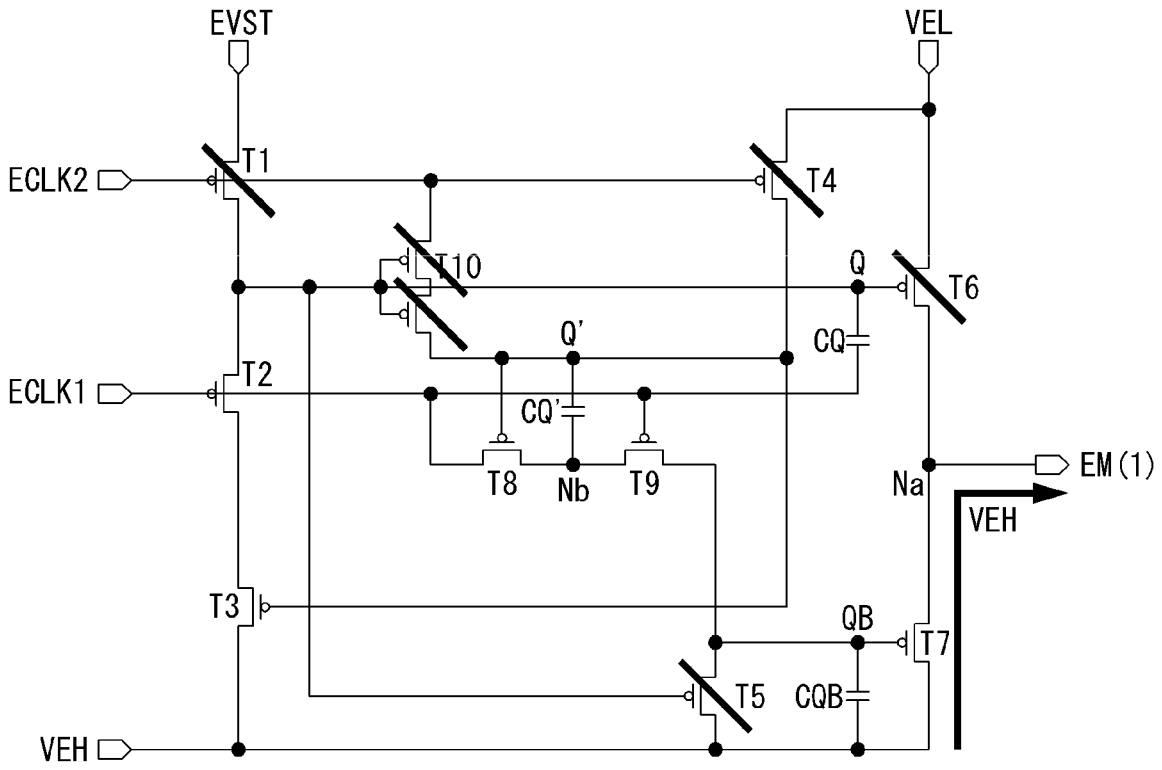

Referring to FIGS. 10 and 11E, in a period ⑤, the external start signal EVST and the clock signal ECLK1 are input at the gate-on voltage VEL, and the clock signal ECLK2 is input at the gate-off voltage VEH.

In the period ⑤, the transistors T2 and T9 are turned on by the clock signal ECLK1 of the gate-on voltage VEL, and the transistors T1 and T4 are turned off by the clock signal ECLK2 of the gate-off voltage VEH. By the turn-off of the transistor T4, the node Q' is floated, and the transistor T8 maintains an on-state. In this instance, when the clock signal ECLK1 of the gate-on voltage VEL is applied to the node Nb through the transistor T8, the voltage of the node Q' is the boosting voltage VEL' lower than the gate-on voltage VEL due to a coupling effect of the node Q' and the capacitor CQ'.

In the period ⑤, the transistor T3 is turned on by the boosting voltage VEL' of the node Q'. Thus, the gate-off voltage VEH is applied to the node Q through the transistors T2 and T3. The transistors T5 and T10 are turned off by the gate-off voltage VEH of the node Q. The clock signal ECLK1 of the gate-on voltage VEL is applied to the node QB through the transistors T8 and T9.

In the period ⑤, the transistor T6 maintains an off-state by the gate-off voltage VEH of the node Q, and the transistor T7 maintains an on-state by the gate-on voltage VEL of the node QB. Thus, the emission signal EM(1) of the gate-off voltage VEH is continuously output to the node Na through the transistor T7.

Figure 11F:
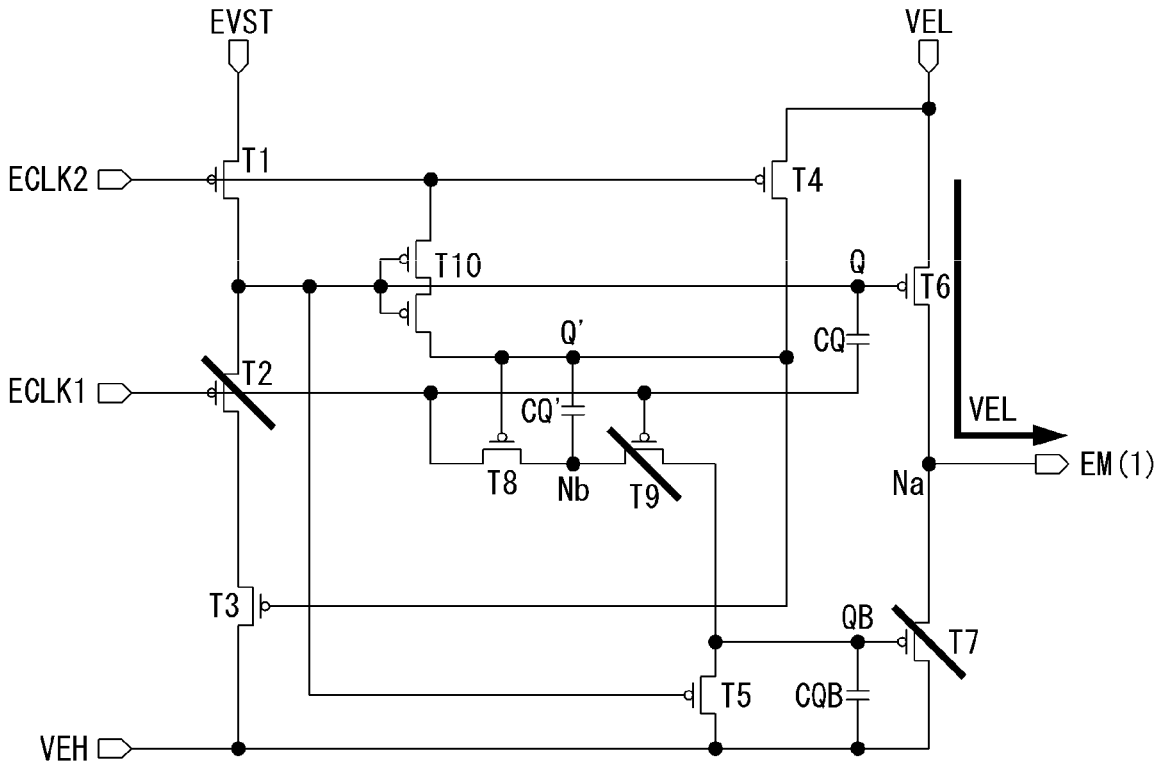

Referring to FIGS. 10 and 11F, in a period ⑥, the external start signal EVST and the clock signal ECLK2 are input at the gate-on voltage VEL, and the clock signal ECLK1 is input at the gate-off voltage VEH.

In the period ⑥, the transistors T1 and T4 are turned on by the clock signal ECLK2 of the gate-on voltage VEL. In this instance, the external start signal EVST of the gate-on voltage VEL is applied to the node Q through the transistor T1. The gate-on voltage VEL is applied to the node Q' through the transistor T4.

In the period ⑥, the transistors T2 and T9 are turned off by the clock signal ECLK1 of the gate-off voltage VEH. The transistors T5 and T10 are turned on by the gate-on voltage VEL of the node Q, and the transistors T3 and T8 are turned on by the gate-on voltage VEL of the node Q'. By the turn-on of the transistor T5, the gate-off voltage VEH is applied to the node QB.

In the period ⑥, the transistor T6 is turned on by the gate-on voltage VEL of the node Q, and the transistor T7 is turned off by the gate-off voltage VEH of the node QB. Thus, the emission signal EM(1) of the gate-on voltage VEL is output to the node Na through the transistor T6.

The period ⑥ is followed by the period ①, and the period ① is followed by the period ⑥. As described above, the period ① and the period ⑥ may alternate with each other many times for a remaining time of one frame period.

As described above, the embodiments of the disclosure can increase change in the voltage of the node Q when the node Q is bootstrapped by setting a ratio of a capacitance of the capacitor CQ connected to the node Q to a total capacitance of the node Q to 50% or more. When change in the voltage of the node Q increases in the bootstrapping of the node Q, the gate-to-source voltage of the first output buffer (i.e., the transistor T6) increases by an increase in the voltage change of the node Q. Thus, the embodiments of the disclosure can stably output the emission signal of the gate-on voltage.

The embodiments of the disclosure can suppress the deterioration of the transistors connected to the node Q and increase the device reliability by additionally connecting the transistor TBv, which is turned off when the bootstrapping is performed, to the node Q.

The embodiments of the disclosure constitute the second output buffer (i.e., the transistors T7 and T7*a*) of the dual gate structure and apply the gate-on voltage to the node Nc between the transistors T7 and T7*a* during the output of the emission signal of the gate-on voltage. Hence, the embodiments of the disclosure can suppress the leakage current of the second output buffer and prevent the emission signal of the gate-on voltage from being distorted by the leakage current of the second output buffer.

Although the embodiments have been described with reference to a number of illustrative embodiments thereof, numerous other modifications and embodiments may be devised by those skilled in the art that will fall within the scope of the principles of this disclosure. In particular, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gate driver comprising:

a plurality of stages including K stages, wherein a k-th stage of the plurality of stages, k being an integer less than K, includes:

a transistor T6 configured to output an emission signal of a gate-on voltage to a node Na of the k-th stage while a node Q of the k-th stage is activated;

a transistor T7 configured to output the emission signal of a gate-off voltage to the node Na while a node QB of the k-th stage is activated;

a Q controller configured to control a voltage of the node Q depending on a voltage of a node Q' of the k-th stage and a clock signal ECLK1 and a clock signal ECLK2 which are in antiphase;

a QB controller configured to control a voltage of the node QB depending on the clock signal ECLK1, the voltage of the node Q, and the voltage of the node Q'; and a capacitor CQ connected between an input terminal of the clock signal ECLK1 and the node Q and having a first capacitance, the input terminal of the clock signal ECLK1 being disposed in the k-th stage, wherein a ratio of the first capacitance to a total capacitance including the first capacitance and a parasitic capacitance formed in the node Q is 50% or more.

2. The gate driver of claim 1, wherein as the ratio of the first capacitance to the total capacitance increases while the voltage of the node Q is bootstrapped, a gate-to-source voltage of the transistor T6 increases.

3. The gate driver of claim 2, wherein the voltage of the node Q is bootstrapped every time the clock signal ECLK1 of the gate-on voltage is input within a period in which the emission signal of the gate-on voltage is output.

4. The gate driver of claim 1, wherein the k-th stage further includes a Q' controller configured to control the voltage of the node Q' depending on the clock signal ECLK1, the clock signal ECLK2, and the voltage of the node Q.

5. The gate driver of claim 4, wherein the QB controller of the k-th stage includes:

a transistor T8 configured to be switched depending on the voltage of the node Q' and apply the clock signal ECLK1 to a node Nb;

a transistor T9 configured to be switched depending on the clock signal ECLK1 and connect the node Nb to the node QB;

a transistor T5 configured to be switched depending on the voltage of the node Q and apply the gate-off voltage to the node QB; and a capacitor CQB connected between the node QB and an input terminal of the gate-off voltage.

6. The gate driver of claim 5, wherein the Q' controller of the k-th stage includes:

a transistor T10 configured to be switched depending on the voltage of the node Q and apply the clock signal ECLK2 to the node Q';

a transistor T4 configured to be switched depending on the clock signal ECLK2 and apply the gate-on voltage to the node Q'; and a capacitor CQ' connected between the node Q' and the node Nb.

7. The gate driver of claim 1, wherein the k-th stage further includes a transistor TBv including one electrode connected to the node Q and a gate electrode connected to an input terminal of the gate-on voltage, wherein the transistor TBv is turned off while the voltage of the node Q is bootstrapped.

8. The gate driver of claim 7, wherein the voltage of the node Q is bootstrapped every time the clock signal ECLK1 of the gate-on voltage is input within a period in which the emission signal of the gate-on voltage is output.

9. The gate driver of claim 1, wherein the k-th stage further includes:

a transistor T7*a* connected to one electrode of the transistor T7 and an input terminal of the gate-off voltage and configured to be switched depending on the voltage of the node QB; and a transistor T11 connected to a node Nc between the transistor T7 and the transistor T7*a* and an input terminal of the gate-on voltage and configured to be switched depending on a voltage of the node Na.

10. The gate driver of claim 1, wherein the Q controller of the k-th stage includes:

a transistor T1 configured to be switched depending on the clock signal ECLK2 and apply a start signal to the node Q;

a transistor T2 configured to be switched depending on the clock signal ECLK1, of which one electrode is connected to the node Q; and a transistor T3 configured to be switched depending on the voltage of the node Q' and apply the gate-off voltage to the other electrode of the transistor T2.

11. A display device comprising:

a display panel including gate lines connected to pixels; and a gate driver according to claim 1, configured to generate an emission signal and supply the emission signal to the gate lines through stages.

12. The display device of claim 11, wherein each pixel includes:

an organic light emitting diode (OLED);

a driving thin film transistor (TFT) configured to control a driving current flowing in the OLED depending on a gate-to-source voltage of the driving TFT; and an emission TFT configured to be turned on or off in response to the emission signal and determine an emission timing of the OLED.

* * * * *